US005627456A

United States Patent [19]

Novof et al.

[11] Patent Number: 5,627,456

[45] Date of Patent: May 6, 1997

[54] ALL FET FULLY INTEGRATED CURRENT REFERENCE CIRCUIT

[75] Inventors: Ilya I. Novof, Essex Junction; John E. Gersbach, Burlington; Frank D. Ferraiolo, Essex Junction, all of Vt.

[73] Assignee: International Business Machines Corporation, Armonk, N.Y.

[21] Appl. No.: 477,208

[22] Filed: Jun. 7, 1995

[51] Int. Cl.[6] ..... G05F 3/20

[52] U.S. Cl. ..... 323/315; 323/907; 323/314

[58] Field of Search ..... 323/312, 313, 323/314, 315, 907

[56] References Cited

U.S. PATENT DOCUMENTS

| | | | |
|---|---|---|---|
| Re. 30,586 | 4/1981 | Brokaw | 323/314 |
| 4,325,018 | 4/1982 | Schade, Jr. | 323/313 |
| 4,352,056 | 9/1982 | Cave et al. | 323/314 |
| 4,357,571 | 11/1982 | Roessler | 323/281 |
| 4,390,833 | 6/1983 | Tzeng | 323/280 |
| 4,769,589 | 9/1988 | Rosenthal | 323/313 |
| 4,808,847 | 2/1989 | Van Kessel | 307/297 |
| 5,117,130 | 5/1992 | Shoji | 307/443 |
| 5,291,123 | 3/1994 | Brown | 323/369 |

*Primary Examiner*—Peter S. Wong
*Assistant Examiner*—Y. J. Han
*Attorney, Agent, or Firm*—Schmeiser, Olsen & Watts; Richard M. Kotulak

[57] ABSTRACT

An integrated current reference circuit provides a current output with a predetermined temperature coefficient, suitably zero, to provide constant current over temperature variations. The circuit is formed of only Field Effect Transistors (FETs), allowing the circuit to be implemented using conventional CMOS fabrication techniques. A current mirror provides a reference current in both branches of the circuit. The output of the current mirror is coupled to a circuit providing an imbalance in resistance between the two branches, and an offsetting imbalance in voltages between the two branches, resulting in a reference current that has a predetermined temperature coefficient. An output current is provided which is proportional to the reference current and thus has the same temperature coefficient as the reference current.

5 Claims, 1 Drawing Sheet

ALL FET FULLY INTEGRATED CURRENT REFERENCE CIRCUIT

BACKGROUND OF THE INVENTION

1. Technical Field

This invention generally relates to current reference circuits, and more specifically relates to an integrated current reference circuit formed exclusively with field effect transistors (FETs) that may be implemented with existing CMOS process flows for high density integrated circuits, such as modern microprocessors and the like.

2. Background Art

Current reference circuits are widely used in microprocessors and Application-Specific Integrated Circuits (ASICs) to supply a constant current for a variety of circuits, including phase-locked loops. Known current reference circuits typically require either pn diodes, resistors, or combinations thereof to establish a reference current. Examples of known reference circuits include: U.S. Pat. No. 4,357,571 "FET Module With Reference Source Chargeable Memory Gate" (issued Nov. 2, 1982 to Roessler and assigned to Siemens); U.S. Pat. No. 5,291,123 "Precision Reference Current Generator" (issued Mar. 1, 1994 to Brown and assigned to Hewlett-Packard Co.); U.S. Pat. No. 5,117,130 "Integrated Circuits Which Compensate for Local Conditions," (issued May 26, 1992 to Shoji and assigned to AT&T Bell Labs); and U.S. Pat. No. 4,808,847 "Temperature-Compensated Voltage Driver Circuit for a Current Source Arrangement" (issued Feb. 28, 1989 to Van Kessel and assigned to U.S. Phillips Corp), which are all incorporated herein by reference.

One well-known type of circuit for generating a reference current is an extrapolated band-gap reference potential circuit. The temperature characteristic of such a circuit is bow-shaped, in that the output tends to have a maximum value at a predetermined temperature and lesser values at higher and lower temperatures, as described in P. Gray and R. Meyer, *Analysis and Design of Analog Integrated Circuits*, Section A4.3.2 Band-Gap Referenced Biasing Circuits, p. 254–61.

One known method of improving the temperature characteristics of a typical current reference circuit is to incorporate a resistor in parallel with a parasitic pn diode. The temperature coefficient of the silicon pn diode is typically approximately −2 mV/degree Kelvin. The temperature coefficient of the parallel resistor is selected to typically offset the temperature coefficient of the pn diode such that the current flowing through the parallel network comprising the pn diode and the resistor remains constant over variations in temperature. One example of such a compensation scheme is disclosed in U.S. Pat. No. 4,325,018 "Temperature-Correction Network With Multiple Corrections As For Extrapolated Band-Gap Voltage Reference Circuits" (issued Apr. 13, 1982 to Schade, Jr. and assigned to RCA Corp.), which is incorporated herein by reference.

The pn diode in known reference circuits is typically created as a p+ diffusion in an n-well in the integrated circuit. However, pn diodes formed in this manner using advanced CMOS processes tend to develop a parasitic Schottky diode in parallel with the pn junction, which creates a large variation in the voltage drop across the diode structure and a high level of current leakage. The problems of the Schottky diode include a significant decrease in the accuracy and stability of the reference current, and increased sensitivity to temperature variations.

Therefore, there existed a need to provide a current reference circuit with enhanced accuracy and stability, that is compatible with existing CMOS process flows, and that provides for an easily adjustable temperature coefficient to reduce overall system temperature sensitivity or to provide for a predetermined temperature coefficient of the current output.

DISCLOSURE OF INVENTION

According to the present invention, an all FET current reference circuit provides a temperature coefficient that may be varied as required by a particular circuit and application, and is fully compatible with existing CMOS process flows. A PFET cascoded current mirror with unity gain is coupled to an NFET current mirror with an imbalance between transistors, creating an imbalance in resistance between the two branches. The NFET current mirror is coupled to two imbalanced NFETs. The imbalance in resistance in the NFET current mirror is selected to partially or completely offset the imbalance in the two imbalanced NFETs. In this manner, changes in one branch of the circuit due to, for example, temperature variations, are partially offset by corresponding changes in the other branch of the circuit, to provide a predetermined temperature coefficient for the reference current flowing in both branches. If the desired temperature coefficient is zero, changes in one branch of the circuit are completely offset by changes in the other branch, resulting in a reference current in the current mirrors that remains constant over variations in temperature, and is thus independent of temperature effects. An output FET is biased with the same gate voltage that is used to bias the PFET current mirror. Thus, the output current through the output transistor will also have the same temperature coefficient as the reference current in the current mirrors. Only FETs are used. In addition, all the FETs that comprise the circuit may be fabricated using traditional known CMOS processing techniques.

The foregoing and other objects, features and advantages of the invention will be apparent from the following more particular description of a preferred embodiment of the invention, as illustrated in the accompanying drawings.

BRIEF DESCRIPTION OF DRAWINGS

The preferred exemplary embodiment of the present invention will hereinafter be described in conjunction with the appended drawings, where like designations denote like elements, and.

BEST MODE FOR CARRYING OUT THE INVENTION

Figure 1:
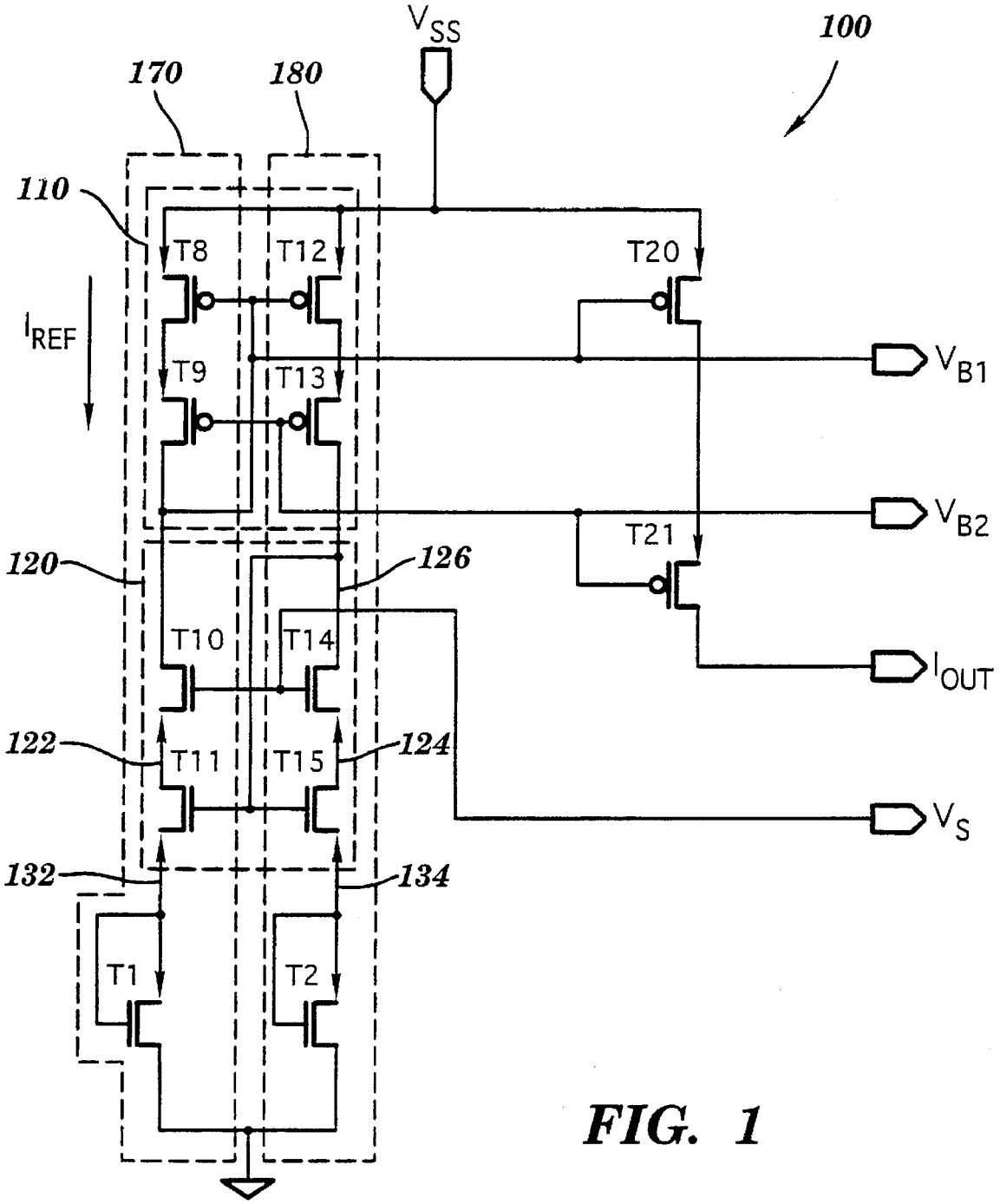
FIG. 1 is a schematic diagram of the current reference circuit in accordance with the present invention.

Referring to FIG. 1, a current reference circuit 100 in accordance with the present invention suitably comprises a first current mirror 110, a second current mirror 120, dissimilar FETs T1 and T2, and output FETs T20 and T21. Current mirror 110 provides the same current $I_{REF}$ in both branches 170 and 180 of circuit 100, current mirror 120 provides an imbalance in resistance between the two branches 170 and 180, and FETs T1 and T2 provide a difference in overdrive voltages. The change in resistance in the first branch 170 is selected to nominally offset the change in voltage in the other branch to maintain a reference current $I_{REF}$ with a predetermined temperature coefficient. An output FET T20 is biased with the same gate voltage as FET T8 in current mirror 110, thus suitably providing a current output that has a predetermined relationship to the reference current, and hence, has the same temperature coefficient as the reference circuit. By appropriately scaling the dimensions of FETs in circuit 100, the reference current $I_{REF}$ may be relatively constant over anticipated temperature variations, thereby providing a current output $I_{OUT}$ that is also independent of temperature effects.

Current mirror 110 suitably induces a current $I_{REF}$ of a predetermined magnitude in each of branches 170 and 180 of circuit 100. Current mirror 110 is suitably coupled between power supply $V_{ss}$ and current mirror 120, as shown in FIG. 1. Power supply $V_{ss}$ may be within a large range of voltage inputs, but for the specific example shown in FIG. 1 the power supply $V_{ss}$ is suitably selected to be +3.3 volts. Current mirror 110 suitably comprises a PFET cascoded current mirror with unity gain formed of PFETs T8, T9, T12 and T13, which all suitably have similar characteristics. T8 and T12 form the basic current mirror, and are biased with voltage $V_{B1}$, which is suitably 2.50 volts for the implementation shown in FIG. 1. T9 and T13 are the cascode transistors that are suitably biased to an appropriate on-chip voltage reference $V_{B2}$ to raise the output impedance of T8 and T12. $V_{B2}$ is selected to suitably keep T8 and T12 just above pinch-off, suitably 1.91 volts for the specific example illustrated in FIG. 1.

Current mirror 120 suitably provides an imbalance in resistance between the two branches 170 and 180 of circuit 100. Current mirror 120 suitably comprises an NFET current mirror coupled to the output of current mirror 110 and formed of NFETs T10, T11, T14 and T15. T11 and T15 form the basic current mirror, and are biased with the voltage at node 126, which is suitably 1.70 volts for the specific implementation shown in FIG. 1. T10 and T14 are suitably biased by another appropriate on-chip voltage reference $V_s$ to raise the output impedance of T11 and T15. $V_s$ is selected to suitably keep T11 and T15 just above pinch-off, suitably 2.12 volts for the specific configuration of FIG. 1. T11 is suitably narrower than T15 to provide an imbalance in their respective resistances, and hence, the resistance in each branch 170 and 180.

NFET T1 and NFET T2 are dissimilar, and suitably have a geometric relationship that makes the voltage across T2 (i.e., voltage at node 134) greater than the voltage across T1 (i.e., voltage at node 132). This can be accomplished by making T2 significantly narrower than T1. The voltage across T1 and T2 is a function of the dimensions (i.e., width and length) of T1 and T2, and may be expressed as:

$$V_{TR1} = V_{T1} + \sqrt{\frac{2I_{TR1}}{\gamma Z_{TR1}}} \quad (1)$$

$$V_{TR2} = V_{T2} + \sqrt{\frac{2I_{TR2}}{\gamma Z_{TR2}}} \quad (2)$$

where $V_{TR}$=voltage across the transistor $V_T$=threshold voltage $\gamma$=MOSFET unit transconductance $I_{TR}$=source to drain current Z=W/L, where W=device width and L=device length Assuming $V_{T1}=V_{T2}$, the difference between the voltage $V_{TR2}$ on T2 and the voltage $V_{TR1}$ on T1 is thus:

$$V_{TR2} - V_{TR1} = \sqrt{\frac{2}{\gamma}}\left(\sqrt{\frac{I_{TR2}}{Z_{TR2}}} - \sqrt{\frac{I_{TR1}}{Z_{TR1}}}\right) \quad (3)$$

The relationship between the width and length of NFETs T1 and T2 are given by equation (3) above. The difference between the voltage on T1 and T2 may thus be selected by appropriate selection of the width and length of T1 and T2. For the specific example shown in FIG. 1, the width of T2 is narrower than the width of T1 such that the voltage at node 132 (i.e., across T1) is suitably 0.639 volts, while the voltage at node 134 (i.e., across T2) is suitably 0.757 volts.

As explained above, T11 is suitably narrower than T15, giving rise to a difference in resistance in T11 and T15, and T2 is suitably narrower than T1, giving rise to a difference in voltage across T1 and T2. Note, however, that these variances occur in opposite branches of circuit 110. In other words, any change in resistance in T11 in branch 170 is suitably offset by a corresponding change in voltage drop across T2 in branch 180, resulting in a predetermined change in current in branches 170 and 180 corresponding to a desired temperature coefficient of current output (preferably zero). Thus, by strategically placing these smaller geometries in opposite branches of circuit 100, the effects caused by the smaller geometries may be selected to somewhat or completely offset each other, resulting in current $I_{REF}$ having a known and predetermined temperature coefficient. By appropriately scaling T11, T15, T1 and T2, any change in branch 170 may be selected to be completely offset by corresponding changes in branch 180, resulting in a temperature coefficient of zero, maintaining $I_{REF}$ as a constant current over temperature variations in circuit 100.

Output FET T20 is biased with the same voltage $V_{B1}$ as FETs T8 and T12. Thus, if T20 is suitably identical to T8, the same magnitude of current $I_{REF}$ flowing in mirror 110 through T8 will also flow as $I_{OUT}$ through output FET T20. In addition, T20 may be selected to have different characteristics (e.g., geometries) than T8, resulting in an appropriate scaling of output current through T20 as a function of the relative characteristics of T8 and T20 and the reference current flowing in T8. A buffer FET T21 suitably biased by $V_{B2}$ may also be provided, which raises the output impedance of $I_{OUT}$ by keeping T20 just above pinch-off For the specific circuit 100 of FIG. 1, with $V_{ss}$=3.3 volts, $V_{B2}$=1.91 volts, $V_s$=2.12 volts, and the appropriate scaling of T11, T15, T1 and T2, the resultant voltages and currents in circuit 100 are: $V_{B1}$=2.50 volts, $V_{122}$=1.11 volts, $V_{132}$=0.639 volts, $V_{126}$=1.70 volts, $V_{124}$=1.12 volts, and $V_{134}$=0.757 volts, resulting in a current $I_{REF}$=55.8 microamps. Assuming T20 has identical characteristics (e.g., dimensions) as T8, output current $I_{OUT}$ will be the same as $I_{REF}$, or 55.8 microamps. Note that appropriate scaling of device geometries of T8 and T20 will result in an output current $I_{OUT}$ that is more or less than $I_{REF}$, while still exhibiting the same temperature coefficient as $I_{REF}$.

Note that circuit 100 will generally not begin functioning as described above until initialized to an operational state. This initialization is performed by a start-up circuit (not shown), which senses if $V_s$ is below a predetermined threshold voltage, and sinks current from $V_{B1}$ until $V_s$ raises above the threshold voltage level. The threshold level of $V_s$ is selected so that circuit 100 operates as a precision current reference once properly initialized.

While the preferred embodiment of the present invention provides for a zero temperature coefficient for the current output $I_{OUT}$, it is within the scope of the present invention to vary the geometries of T11, T15, T1 and T2 to achieve any desired temperature coefficient for circuit 100. Thus, if a current reference is desired that has a predetermined positive or negative temperature coefficient with respect to the output current $I_{OUT}$, the device geometries of T11, T15, T1 and T2 could be appropriately selected to achieve the desired temperature coefficient for circuit 100.

A significant advantage of the circuit 100 in accordance with the present invention is that the entire circuit is implemented with only FETs, without any bipolar pn junctions and without any integrated resistors. As a result, circuit 100 may be fabricated using standard CMOS circuit techniques, without the need to modify the process flow to provide a precision current reference.

Another advantage of circuit 100 is that current output $I_{OUT}$ is insensitive to variations in power supply $V_{ss}$. Since circuit 100 depends on current $I_{REF}$, current output $I_{OUT}$ will have the predetermined temperature coefficient even if $V_{ss}$ varies. Circuit 100 thus provides a precision current source without requiring a high precision voltage source as a power supply.

While the invention has been particularly shown and described with reference to a preferred exemplary embodiment thereof, it will be understood by those skilled in the art that various changes in form and details may be made therein without departing from the spirit and scope of the invention. For example, while FETs T9, T13, T11, T15 and T21 are shown in FIG. 1 and described with respect to the preferred exemplary embodiment of the present invention to enhance the operation of circuit 100 by increasing the output impedance of $I_{OUT}$, circuit 100 will still operate in accordance with the present invention without these FETs.

We claim:

1. A current reference circuit for providing a predetermined current output with a predetermined temperature coefficient, comprising:

a first voltage supply, a ground node, and an output node;

a current mirror, coupled to the first voltage supply, for providing a reference current of equal magnitude in each of two branches of the circuit;

control means, coupled between the current mirror and the ground node, for compensating for variations in one branch with corresponding variations in the other branch, to provide the reference current in each branch with the predetermined temperature coefficient; and current output means, coupled between the first voltage supply and the output node, and coupled to the current mirror, for providing the current output with the predetermined temperature coefficient:

wherein the circuit is made only from field effect transistors.

2. The circuit of claim 1 wherein the current mirror comprises a PFET current mirror with unity gain, and wherein the control means comprises:

an NFET current mirror coupled to the PFET current mirror, the NFET current mirror having dissimilar transistors for providing an imbalance in resistance between the two branches;

a first NFET disposed in the first branch of the circuit;

a second NFET, having different voltage characteristics than the first NFET, disposed in the second branch of the circuit;

the imbalance in resistance being at least partially offset by the different voltage characteristics to provide the reference current in each branch with the predetermined temperature coefficient.

3. The circuit of claim 1 wherein the predetermined temperature coefficient is substantially zero.

4. A method for providing an integrated current reference circuit having a predetermined current output with a predetermined temperature coefficient, comprising the steps of:

providing a first voltage supply, a ground node, and an output node;

providing a current mirror made only from field effect transistors, the current mirror being coupled to the first voltage supply and providing a reference current of equal magnitude in each of two branches of the circuit;

providing a control circuit made only from field effect transistors, the control circuit being coupled between the current mirror and the ground node, the control circuit compensating for variations in one branch with corresponding variations in the other branch, to provide the reference current in each branch with the predetermined temperature coefficient;

providing a current output circuit coupled between the first voltage supply and the output node, and coupled to the current mirror, the circuit providing the current output with the predetermined temperature coefficient;

selecting the attributes of the control means in the first branch and the control means in the second branch to provide the predetermined temperature coefficient.

5. The method of claim 4 wherein selecting the attributes of the control means comprises selecting the geometries of the field effect transistors in the first branch to have a predetermined relationship to the geometries of the field effect transistors in the second branch.

* * * * *